US006735914B2

(12) United States Patent
Konopka

(10) Patent No.: US 6,735,914 B2
(45) Date of Patent: May 18, 2004

(54) LOAD BEARING WALL

(76) Inventor: Peter J. Konopka, 19411 Collins Rd., Marrengo, IL (US) 60152

( * ) Notice: Subject to any disclaimer, the term of this patent is extended or adjusted under 35 U.S.C. 154(b) by 0 days.

(21) Appl. No.: 10/190,095

(22) Filed: Jul. 3, 2002

(65) Prior Publication Data

US 2004/0003567 A1 Jan. 8, 2004

(51) Int. Cl.[7] ..... E04C 1/00
(52) U.S. Cl. ..... 52/309.11; 52/309.12; 52/446; 52/344; 52/262
(58) Field of Search ..... 52/309.11, 309.12, 52/446, 262, 342, 343, 344

(56) References Cited

U.S. PATENT DOCUMENTS 4,472,919 A * 9/1984 Nourse ..... 52/601
4,486,993 A * 12/1984 Graham et al. ..... 52/262
4,489,530 A 12/1984 Chang
4,625,484 A * 12/1986 Oboler ..... 52/251
4,702,058 A * 10/1987 Bennett ..... 52/584.1
4,864,792 A * 9/1989 Andre et al. ..... 52/426
4,987,719 A 1/1991 Goodson, Jr.
5,119,606 A * 6/1992 Graham ..... 52/125.4
5,493,836 A * 2/1996 Lopez-Munoz ..... 52/602
5,596,860 A 1/1997 Hacker
5,809,717 A 9/1998 Scarborough et al.
5,881,516 A 3/1999 Luedtke, deceased
6,073,417 A 6/2000 Hackett
2002/0124508 A1 * 9/2002 Dunn et al.

* cited by examiner

*Primary Examiner*—Carl D. Friedman
*Assistant Examiner*—Nahid Amiri
(74) *Attorney, Agent, or Firm*—Brinks Hofer Gilson & Lione

(57) ABSTRACT

A load bearing composite building wall structure comprising a plurality of spaced-apart stud members, each stud member comprising an exterior bar member, an interior bar member, and a plurality of wall ties connected there between. Interstitial blocks comprising a generally self-supporting material are disposed between adjacent pairs of stud members. A surface coating material is disposed along the exterior and interior faces of the wall structure and in contact with the interstitial blocks. The surface coating material has an increased thickness in an area adjacent to one or more stud members. The increased thickness of the surface coating material provides an increase in the load bearing capacity of the wall structure.

58 Claims, 12 Drawing Sheets

LOAD BEARING WALL

BACKGROUND OF THE INVENTION

The field of the invention relates to building structures, and more particularly, to composite wall structures, and to methods of constructing composite wall structures, comprising a lattice structure with interstitial material contained therein.

Conventional building wall structures are usually constructed using a variety of materials such as wood, steel, masonry, or concrete, and are formed on site by well known construction methods. The construction of building wall structures using conventional materials and construction methods has certain disadvantages. For example, conventional building wall structures often require significant time to construct, which may increase the overall construction cost of the building. Moreover, since conventional building wall structures must be constructed on site, inclement weather or other factors may result in construction delays or increased construction costs.

In addition, conventional building wall structures are often poor insulators. Thus, buildings constructed using conventional building wall structures often require large heating and/or cooling systems to maintain interior temperatures that are comfortable for the building's occupants. Moreover, the energy requirements and costs needed to operate these heating and/or cooling systems can be significant, particularly if the building is not located in a temperate climate.

In an attempt to overcome some of the problems associated with conventional building wall structures, modular walls or wall panels have been developed for use as building wall structures. For example, building wall structures have been constructed with modular building panels of plastic foam material reinforced by a lattice of light gauge rod or wire. Building wall structures have also been constructed by erecting a lattice having wall boards attached to both sides thereof. The space between these wall boards is filled with a resin material. Similarly, building wall structures have been constructed using foamed plastic panels having a series of spaced-apart flanges held in position by transversely connected wires. The space between these plastic panels is filled with foam, and the exterior surface of the panels is plastic coated.

Modular walls or wall panels have a number of advantages over conventional building wall structures. For example, the modular walls or wall panels can be manufactured in a controlled environment, such as a factory. These components can then be delivered to the job site where they can be quickly assembled to form the completed building wall structure. As such, they are generally a less time-consuming alternative to conventional building wall structures.

In addition, the above-described modular wall structures are generally better insulators than conventional building wall structures. For example, many of the these modular wall structures utilize plastic or foam materials that are poorer heat conductors as compared to conventional building materials such as steel or concrete. However, these modular wall structures typically utilize structural elements that compromise the insulating capacity of the finished wall. For example, modular wall structures typically utilize metal ties, bars or wires to hold the inside and outside panels together. These metal components provide pathways for heat to pass through the walls, thereby compromising the insulating capacity of the wall structure.

The modular walls or wall panels that have been previously developed also have a number of disadvantages or limitations that make them impractical or unsuitable for many applications. For example, many of the above-described modular wall structures lack the strength necessary to function as load bearing walls. Many of the above-described modular wall structures also lack the resilience necessary to withstand the rigors of weather. In addition, the materials, such as the resins and high strength plastics utilized in many of these modular wall structures, are often expensive and difficult to apply. As a consequence, the cost of these modular wall structures often compare unfavorably to the cost of conventional building wall structures.

In view of the above, it is therefore highly desirable to provide a building structure having the advantages of modular wall structures, with the low-cost, strength and resilience of conventional building walls. It is also highly desirable to provide a building wall structure having an improved insulating capacity. It is also desirable to provide a method of constructing a building wall structure having the above-described features.

BRIEF SUMMARY OF THE INVENTION

Accordingly, an object of the present invention is to provide a new and improved building structure which overcomes the problems or limitations of the conventional and modular building structures discussed above. In particular, it is an object of the present invention is to provide a new and improved building structure for use as the exterior walls or roof of a building structure. It is another object of this invention to provide an improved building structure having superior insulating qualities as compared with modular and conventional building wall structures. It is also an object of the present invention to provide an improved building structure having superior load bearing capacities. Finally, it is an object of this invention to provide an improved building structure and building method that is relatively inexpensive to assemble at the construction site.

In preferred aspects, the present invention is embodied in a composite building wall or roof structure comprising a lattice structure with interstitial material contained therein. In particular, and as described in connection with the illustrative embodiment depicted herein, the present invention comprises a composite building wall structure having a plurality of vertically disposed stud members positioned in a spaced-apart and generally parallel fashion. Interstitial blocks formed of good insulating materials are positioned between adjacent stud members and are held together by a plurality of horizontal bar members extending between stud members. The interior and exterior surfaces of the wall structure are then covered with a strong and durable material such a concrete.

In one aspect of the invention, the surface of the interstitial blocks have been shaped or modified to provide channels adjacent to the stud members. These channels act to increase the thickness of the surface material (e.g., concrete) so as to increase the load bearing capacity of the wall structure.

These and other advantages, as well as the invention itself, will become apparent in the details of the structure and method of construction as more fully described and claimed below. Moreover, it should be appreciated that several aspects of the invention can be used with other types of building structures and methods.

BRIEF DESCRIPTION OF SEVERAL VIEWS OF THE DRAWINGS

The above mentioned and other features and objects of this invention and the manner of attaining them will become more apparent and the invention itself will be best understood by reference to the following description of the invention taken in conjunction with the accompanying drawings wherein.

DETAILED DESCRIPTION OF THE INVENTION

Figure 1:
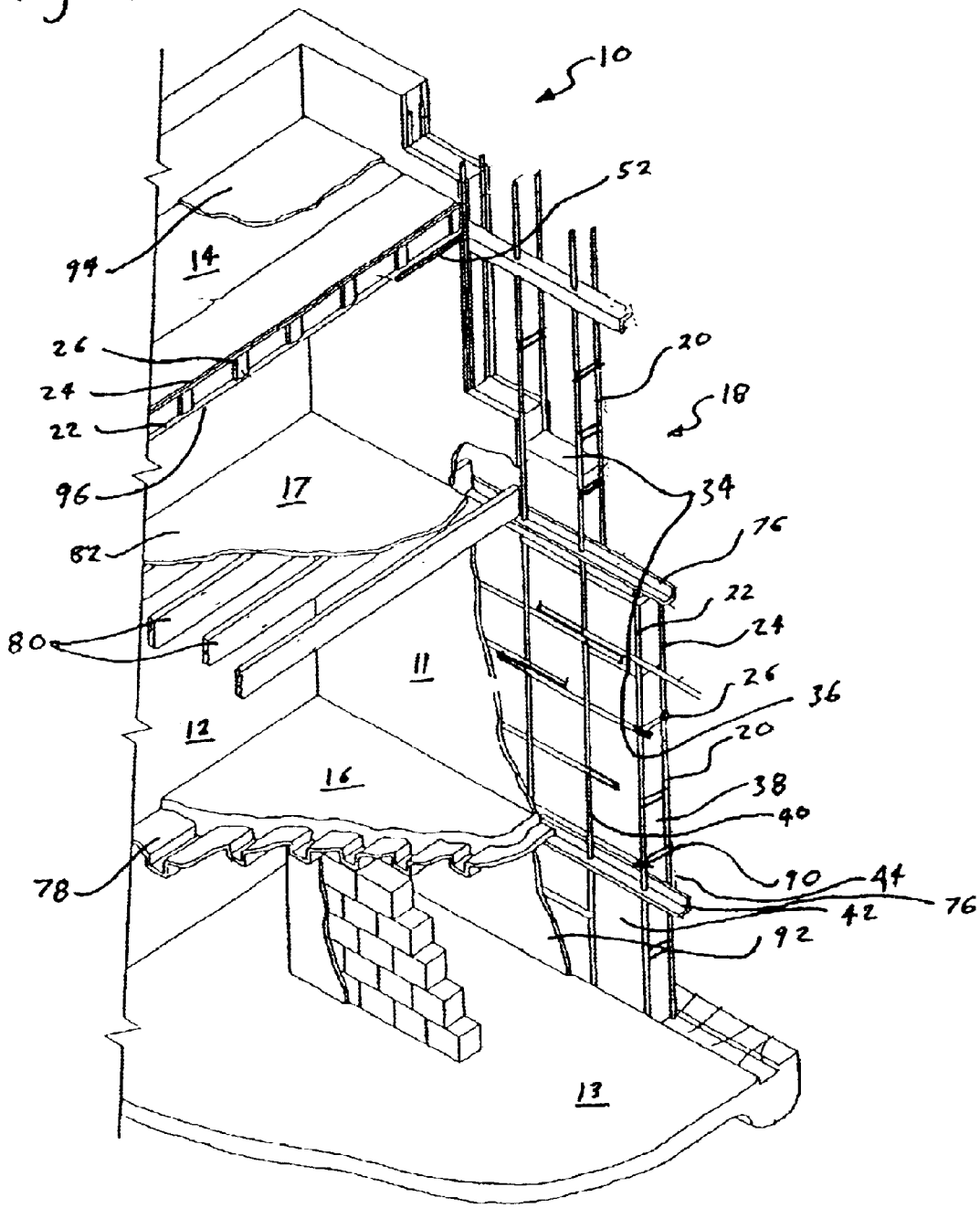
FIG. 1 is a perspective view of an interior corner portion of a building shell constructed in accordance with the present invention, the building shell comprising an integrally poured concrete floor and footing, two intersecting walls, two floors of differing construction, and a roof.

Referring to FIG. 1, a building shell 10 is illustrated showing two intersecting wall structures 11,12 and a roof structure 14 of the improved building structure of the present invention secured to an integrally poured concrete floor and footing 13. The building shell 10 is also shown having floors 16 and 17 extending between the walls 11 and 12. The wall structures 11 and 12 and the roof structure 14 generally comprise the basic building structure 18 illustrated in FIG. 2. In as much as many of the elements of the building structure 18 are the same, like reference numerals will be used herein to indicate like structures.

Figure 2:
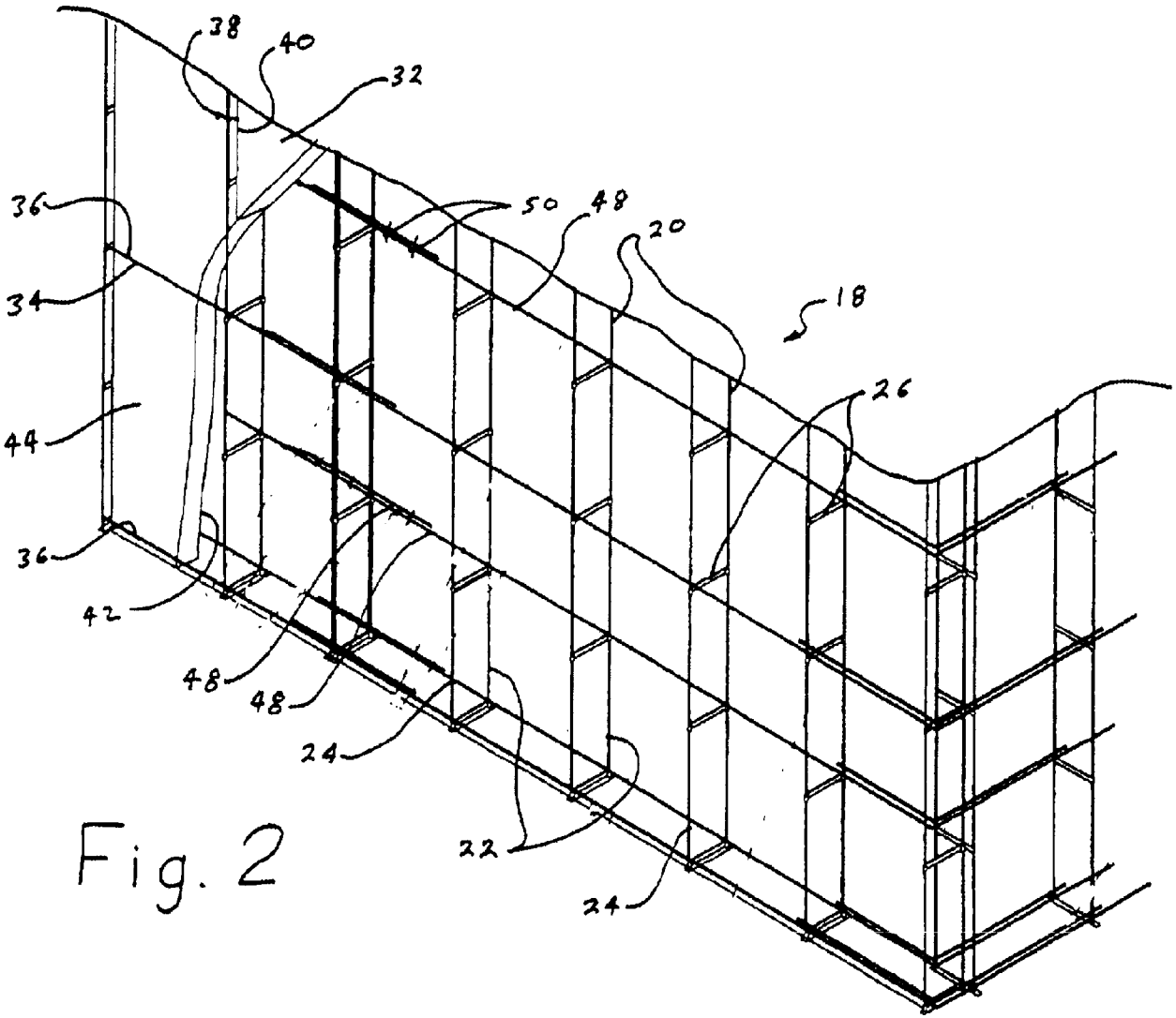
FIG. 2 is a perspective view of a building wall structure of the present invention having the surface coating partially removed so as to illustrate the interior lattice assembly.

Referring to FIG. 2, the building structure 18 comprises a plurality of spaced-apart and generally parallel stud members 20. As used herein, the word "stud" is used generically, and includes similar structural elements such and roof and floor joists. Each of the stud members 20 typically comprises a pair of spaced-apart and generally parallel rod members 22, 24. In the preferred embodiment shown, rod members 22, 24 each comprise standard reinforcing bars, and in particular, #3 Grade 60 rebar. The distance between the rod members 22 and 24 is somewhat less than the total thickness of the finished wall structures 11, 12 or roof structure 14 so that the rod members 22, 24 will be encased within the surface coating 90, 92, 94, 96 of these structures.

Figure 4:
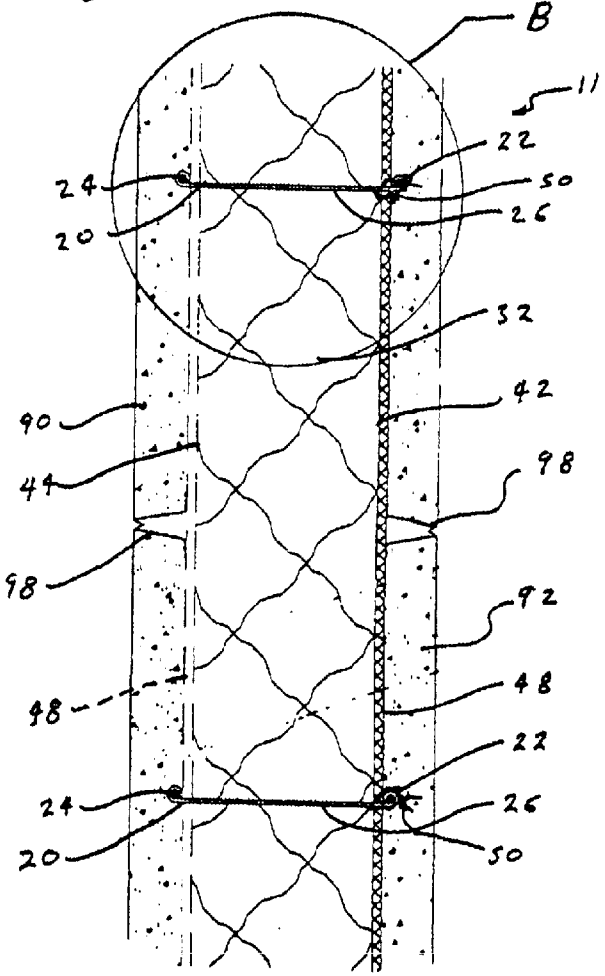
FIG. 4 is a horizontal cross-sectional view of the building wall structure shown in FIG. 2.
Figure 3:
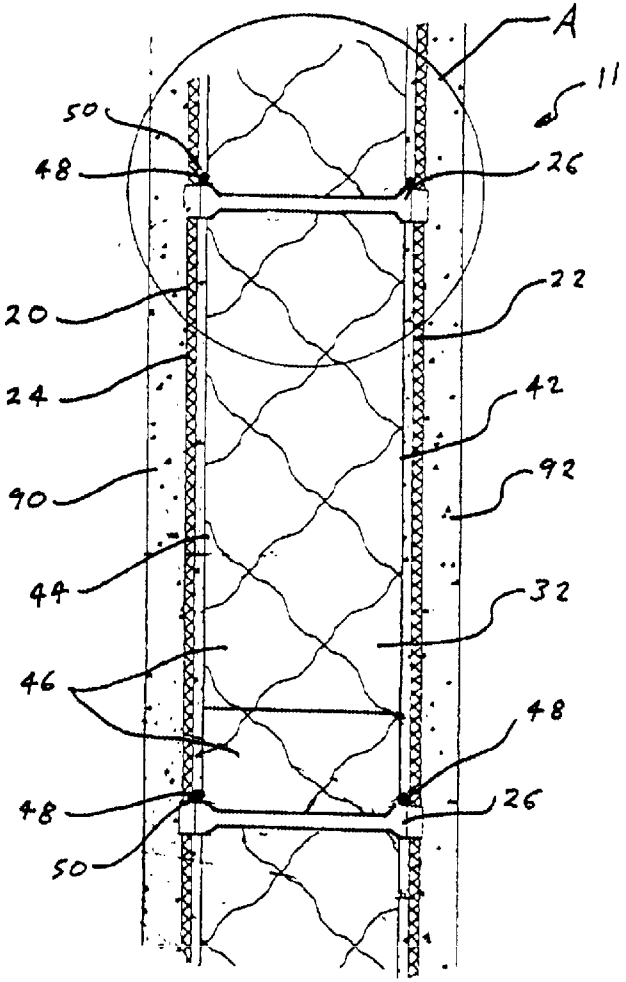
FIG. 3 is a vertical cross-sectional view of the building wall structure shown in FIG. 2.
Figure 3A:
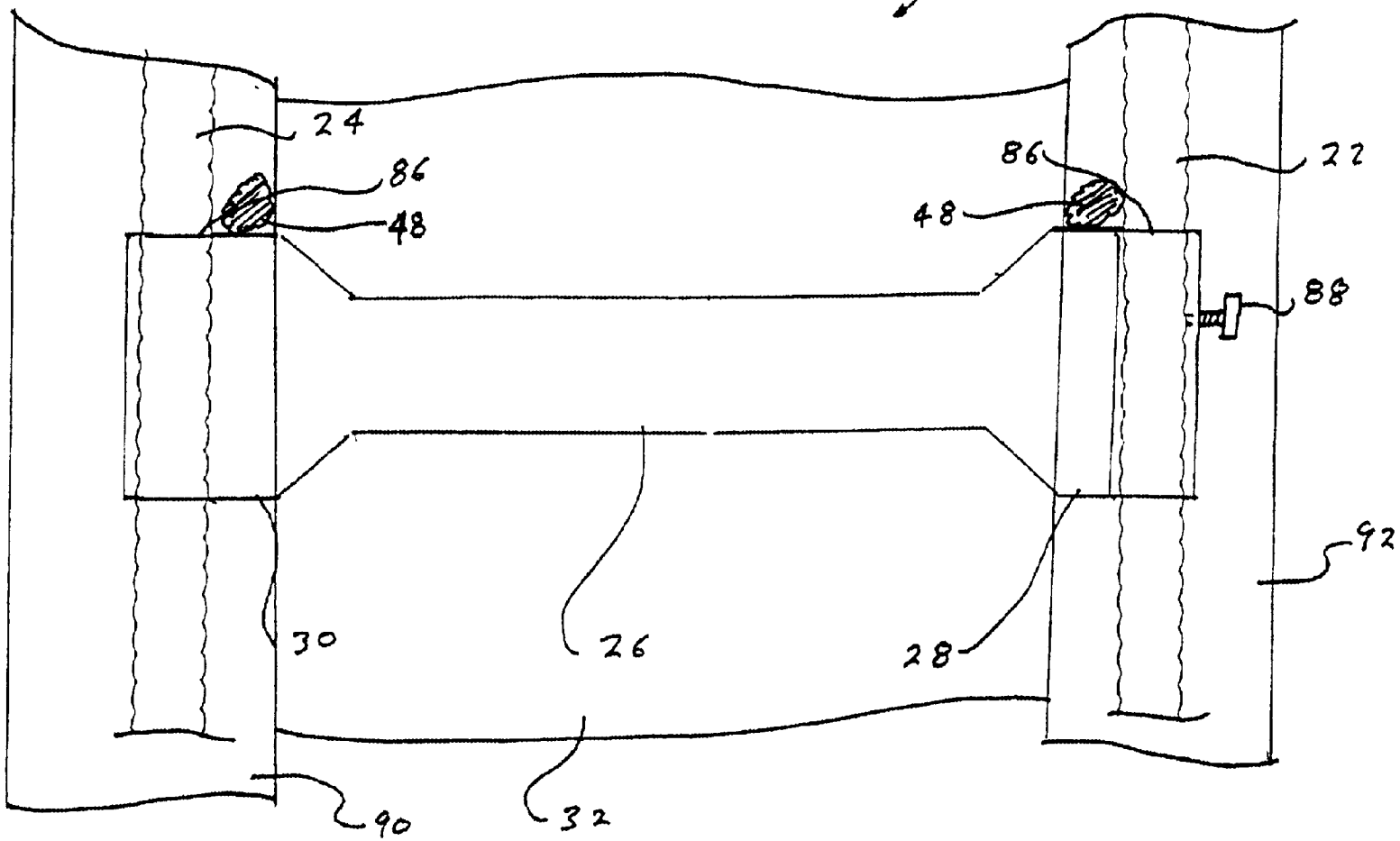
FIG. 3A is an enlarged view of portion "A" of the wall structure shown in FIG. 3.
Figure 4A:
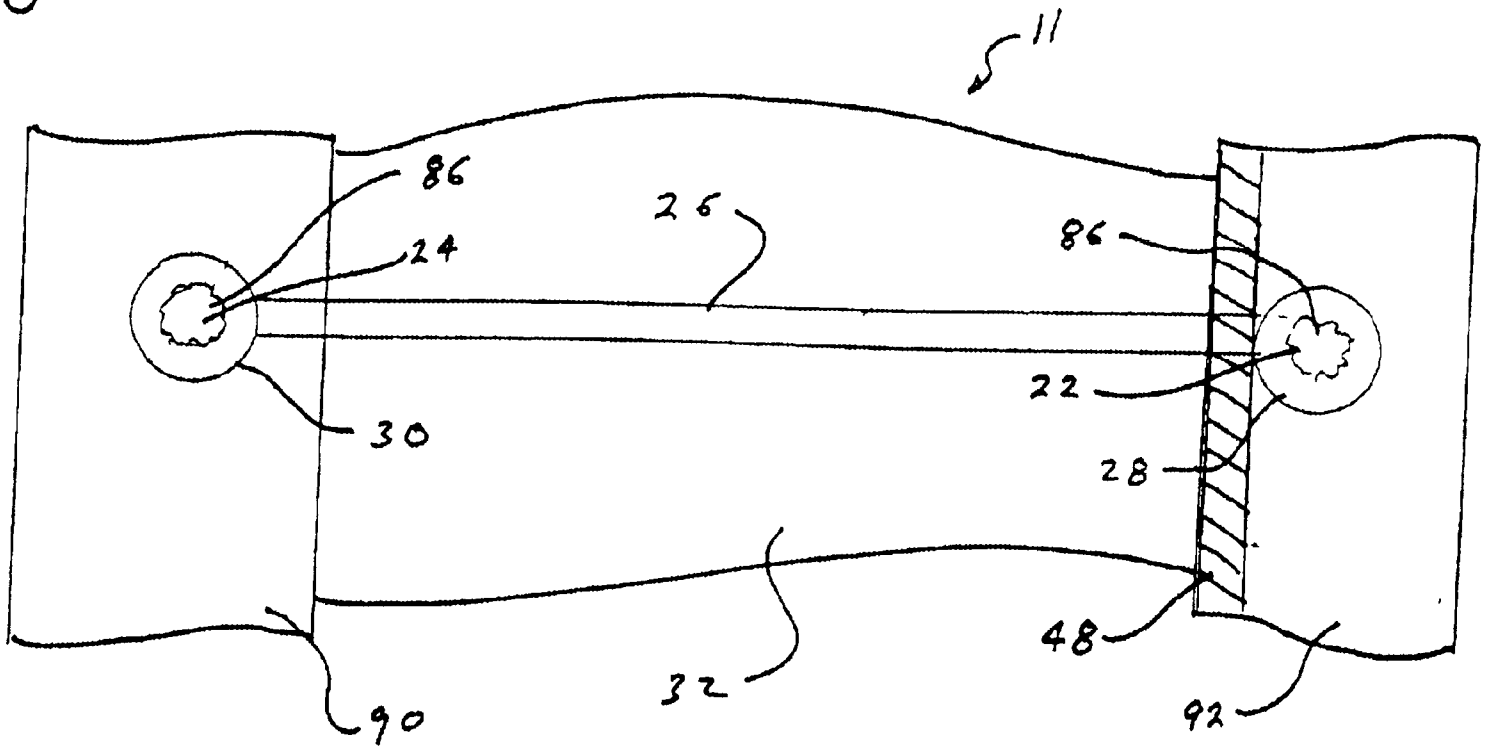
FIG. 4A is an enlarged view of portion "B" of the wall structure shown in FIG. 4.

The rod members 22, 24 are connected together by a series of composite wall ties 26. As best seen in FIGS. 3 and 3A, one end 28 of each wall tie 26 is attached to rod member 22, and the other end 30 of each wall tie 26 is attached to rod member 24. As best seen in FIGS. 4 and 4A, ends 28, 30 each comprise an opening 86 through which rod members 22, 24 are inserted. As will be explained below, the length of wall ties 26 depends on the thickness of the interstitial columns 32 and the desired spacing between rod members 22 and 24. In the preferred embodiment shown, the spacing between the center of the openings 86 at each end 28, 30 of the wall ties 26 measures 7.375", and the overall length of the wall ties measures 8.25". In the preferred embodiment illustrated, each of the wall ties 26 is secured to rod members 22, 24 by a set-screw 88. Alternatively, wall ties 26 are secured to rod members 22, 24 by metal or plastic ties (not shown), by conventional welding, or by some other suitable means for fastening these components together.

As will be explained in greater detail below, the rod members 22, 24 and wall ties 26 of the stud members 20 act as an internal truss for supporting wall structures 11, 12. Moreover, because these components can slide or move with respect to each other, the exterior 90 and interior 92 surfaces of the wall structures 11, 12 can expand or contract without causing damage or a loss of structural integrity thereto. This is particularly important for locations where the outside air temperature is significantly higher or lower that the interior temperature of the building structure 10, thereby causing the exterior 90 and interior 92 surfaces of the wall structures 11, 12 to expand or contract with respect to each other.

In the specific embodiment illustrated herein, wall ties 26 each comprise a composite material made of metal and plastic. The composite material of the preferred embodiment exhibits low heat transmission to prevent the exchange of heat between the interior bar member 22 and the exterior bar member 24. This prevents heat (or cold) from being transferred between the exterior surface 90, 94 and the interior surface 92, 96 of the wall 11, 12 and roof 14 structures. The composite material of the preferred embodiment should also exhibits a sufficient flexibility to permit the exterior 90, 94 and the interior surface 92, 96 of the wall 11, 12 and roof 14 structures to expand or contract with respect to each other. Nevertheless, the composite material must be sufficiently strong to hold rod members 22, 24, and consequently exterior 90, 94 and the interior surface 92, 96, together.

In the preferred embodiment, wall ties 26 each comprise a composite material with a grade of dielectric 44-10 HG, which is a chemical and weather resistant molding compound with higher strength than 44-10, good corrosion resistance, and good electrical properties including flame and track resistance.

Of course, it should be appreciated that wall ties 26 can have any number of shapes, and comprise any number of materials, so long as the above-described parameters of sufficient strength and low heat transfer are satified.

As best seen in FIG. 1, an interstitial column 32 is positioned between each pair of adjacent stud members 20. In a flat wall or roof structure, interstitial columns 32 are generally rectangular in shape, and comprise opposing top 34 and bottom 36 end surfaces, opposing edge surfaces 38 and 40, and opposing interior 42 and exterior 44 side surfaces. Accordingly, each stud member 20 is positioned between the edge surfaces 38 and 40 of adjacent pairs of interstitial columns 32. In the preferred embodiment shown, stud members 20 are spaced at 2' intervals. Accordingly, interstitial columns 32 are likewise 2' in width.

As best seen in FIG. 4, the spacing between each pair of adjacent the stud members 20 determine the distance between edge surfaces 38 and 40 (i.e., the width of columns 32). The distance between the interior and exterior surfaces 42 and 44 (i.e., the thickness of columns 32) is slightly less than the width of stud members 20. In the preferred embodiment shown, interstitial columns 32 each have a thickness of about two inches less than the distance between rod members 22 and 24, and a width equal to the spacing of stud members 20. As best seen in FIG. 3, each of the interstitial columns 32 may be comprised of a plurality of interstitial blocks 46 stacked in an edge-to-edge relationship.

Figure 4B:
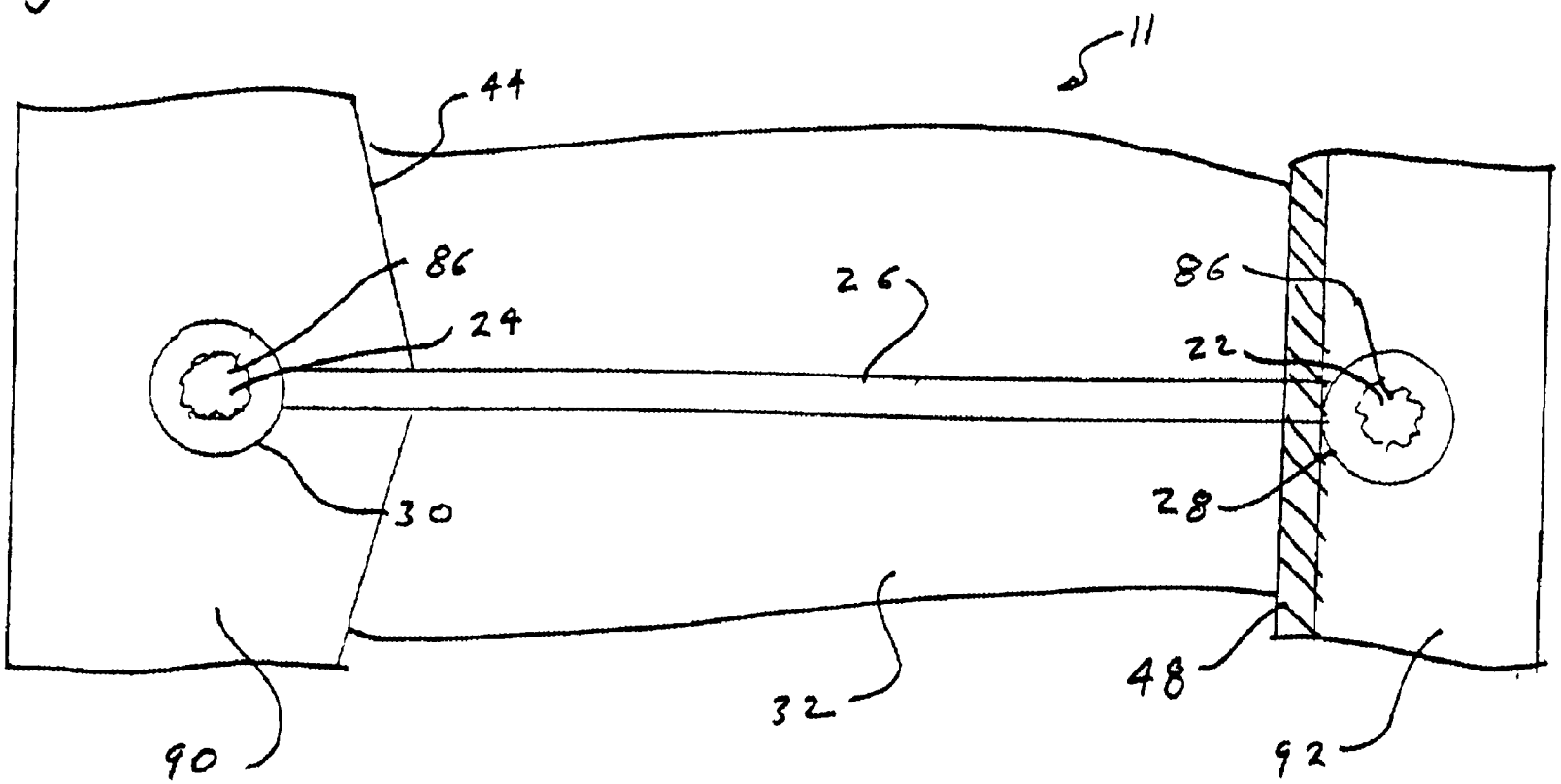
FIG. 4B is an enlarged view of a portion of an alternative wall structure depicting the same portion of the wall as shown in FIG. 4A.
Figure 4C:
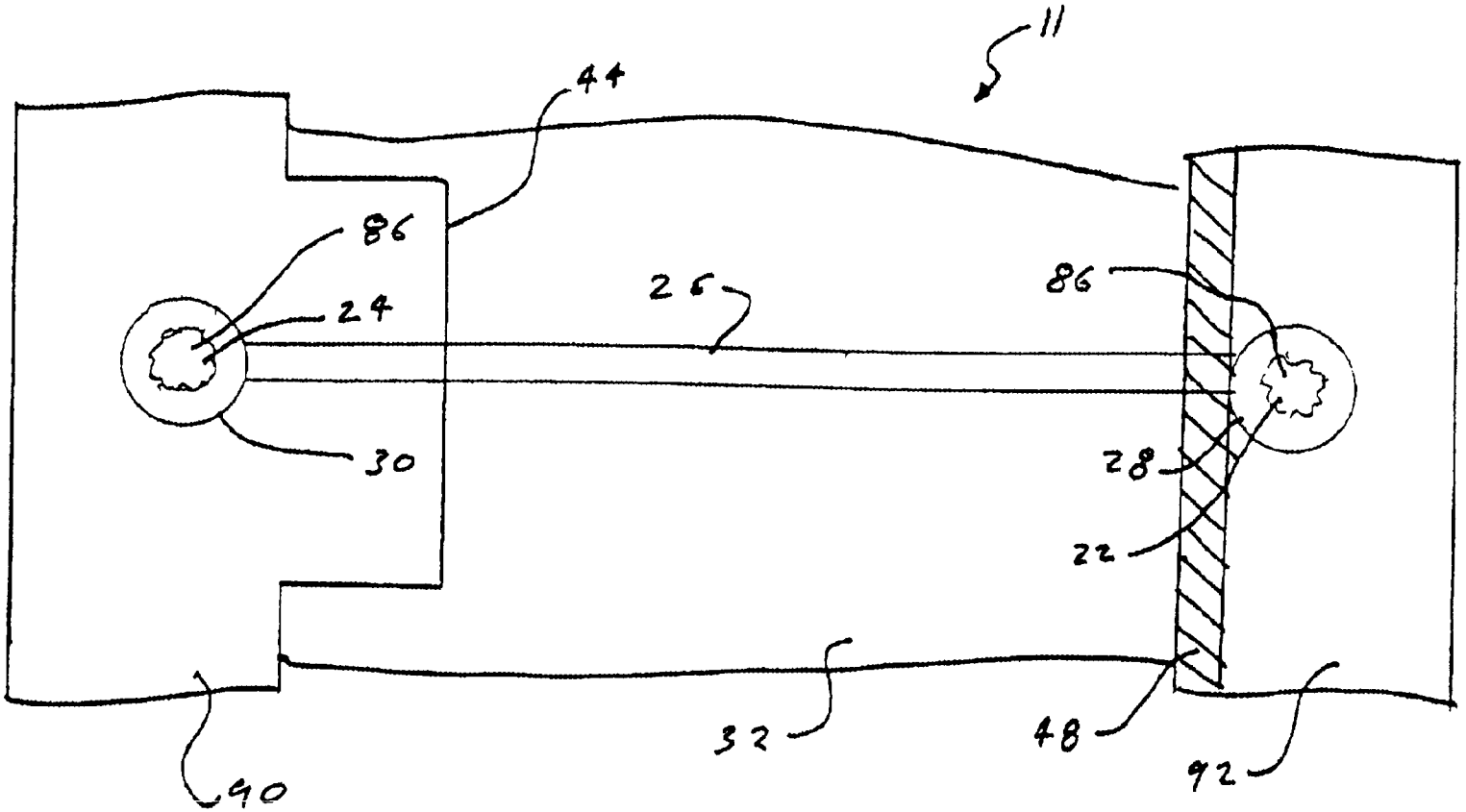
FIG. 4C is an enlarged view of a portion of another alternative wall structure depicting the same portion of the wall as shown in FIG. 4A.

As best seen in FIGS. 4B and 4C, the shape of the interstitial columns 32 can be altered to increase the strength and/or load carrying capacity of the wall structure 11, 12. For example, and as shown in FIG. 4B, the edges of interstitial columns 32 have been tapered so as to increase the distance between the exterior surface 44 of the interstitial blocks 32 and rod member 24. As will be explained in greater detail below, the area surrounding the rod member 24 is subsequently filled with a surface material 90 such as concrete. This surface material 90, in combination with the rod member 24, creates a structural member capable of carrying substantial vertical loads. By increasing the thickness of the surface material 90 adjacent to the rod member 24, the load carrying capacity of the wall structure 11, 12 can be substantially increased.

The embodiment shown in FIG. 4C is similar that of FIG. 4B. However, the edges of interstitial columns 32 have been notched, as opposed to tapered, so as to increase the distance between the exterior surface 44 of the interstitial blocks 32 and rod member 24.

It should be understood that that the embodiments of FIGS. 4B and 4C can also be incorporated along the interior of the wall structures 11, 12.

In the specific embodiment illustrated herein, interstitial columns 32 are made of polystyrene foamed material. The advantage of this material is that it is readily available at a reasonable cost. However, other filler materials of similar density and insulating capabilities can also be used. In the specific embodiment in which polystyrene foam is utilized, the building structure of the invention provides a wall structure and a roof structure that has better insulating properties than wall and roof structures of conventional design. While all of the plastic foam materials being used in modular building panels can be utilized, the invention contemplates that these materials would also be provided in block form or column foam and would be constructed on the site as above described. Columns 32 can also comprise hollow boxes of plastic, wood or other rigid materials, either empty or filled with conventional insulating materials. The invention contemplates and the words "block" and "column" and derivatives thereof are used herein to include all of these structures.

The alternating stud members 20 and interstitial columns 32 of building structure 18 are bound together to form an integral load bearing wall or roof structure by a plurality of transversely extending rods 48. In the preferred embodiment shown, transverse rods 48 comprise conventional ⅜" reinforcing rods. As best seen in FIGS. 3 and 4, transverse rods 48 are positioned between rods 22, 24 (of the stud members 20) and the columns 32. Moreover, since columns 32 are nearly as thick as the distance between rods 22 and 24, transverse rods 48 are typically wedged between the interior 42 and exterior 44 surfaces of the columns 32, and the rods 22 and 24, respectively. This arrangement helps to hold the transverse rods 48 in position, as well as spacing the rods 22 and 24 a short distance away from interior 42 and exterior 44 surfaces, respectively, of columns 32. As will be explained in greater detail below, this permits the surface coating 90, 92 to completely surround and embed rods 22 and 24.

Ties 50 may also be used to hold the transverse rods 48 to the rods 22, 24. In addition, and depending on the spacing of the wall ties 26, the transverse rods 48 may also be positioned so as to rest upon the upper surface of the wall ties 26. In the preferred embodiment shown, transverse rods 48 are alternatively spaced at 4' intervals along the interior 42 and exterior 44 surfaces, respectively, of columns 32.

As set forth above, transverse rods 48 preferably comprise standard reinforcing bars. Conventional reinforcing bars are manufactured in finite lengths that are often less than the length of the building wall 11, 12 or roof structure 14. As best seen in FIG. 2, individual transverse rods 48 are joined together by overlapping the ends thereof for a length sufficient to "hold" the individual transverse rods 48 together by frictional forces. In the preferred embodiment shown, transverse rods 48 are overlapped for a distance of approximately 30". Ties 50 are also typically used to hold the overlapping ends of the transverse rods 48 together until the surface coating 90, 92 has been applied to the wall structure 11.

Similarly, stud members 20 may be constructed and delivered at the job site in manageable lengths. However, since stud members 20 typically extend the entire height of the building shell 10, separate stud members 20 may have to be connected together in an end-to-end relationship to provide a continuous stud member 20 of the length desired. This is typically achieved by overlapping rod members 22, 24 a sufficient length to "hold" these components together by frictional forces. Alternatively, the ends of rod members 22, 24 can be fitted with threaded connectors (not shown).

It should be appreciated that the size and shape of interstitial columns 32, the size and spacing of stud members 20, and the size and spacing of transverse rods 48 will vary depending upon the design characteristics of the building shell 10. Likewise, the number, size and spacing of these components will vary depending upon local building codes, the design load to be carried by the wall structure, or the span of the roof structure. Consequently, it should be understood that the embodiments described above are merely illustrative, and that the present invention can be incorporated into any number of variations utilizing the same basic design structure.

Figure 5:
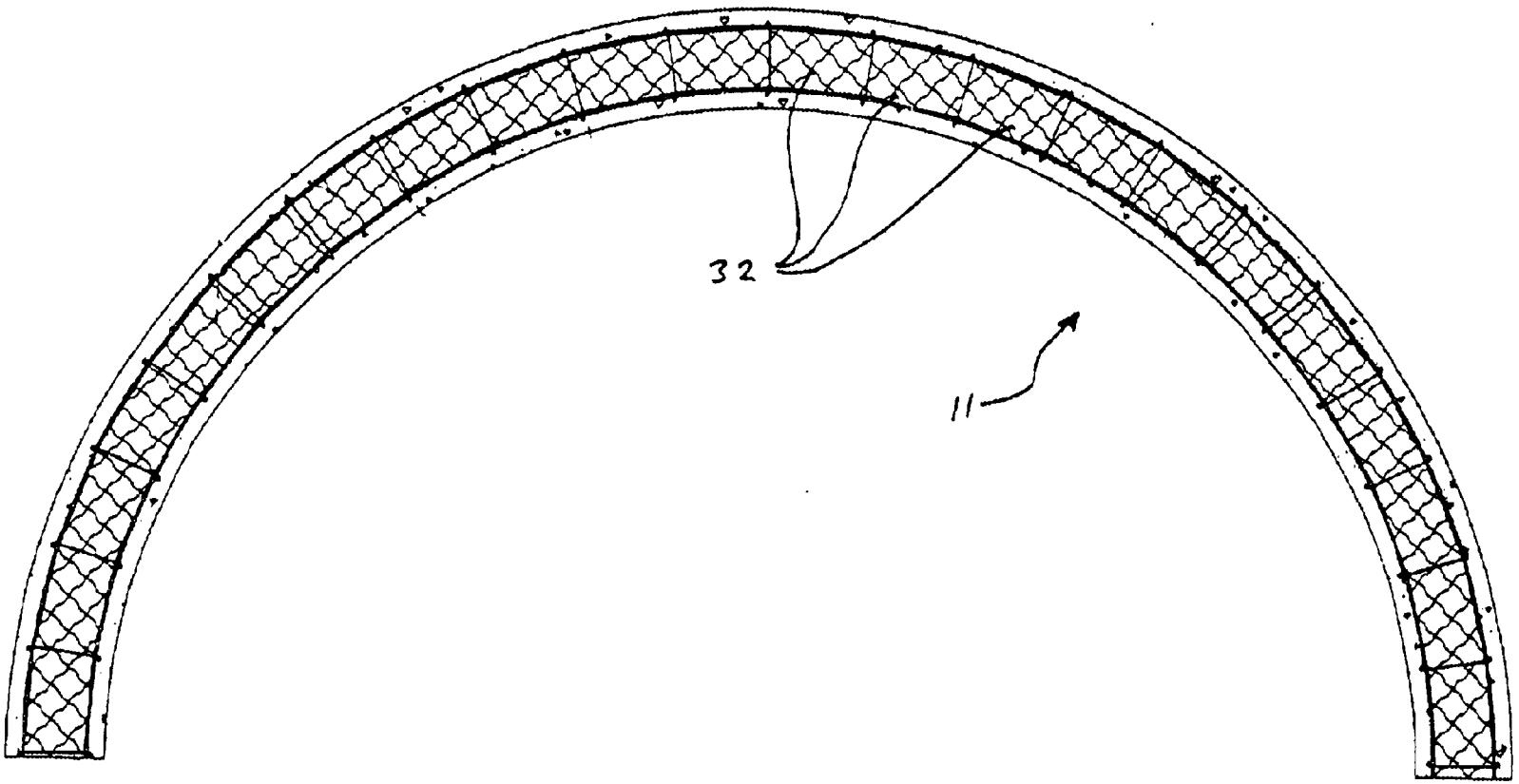
FIG. 5 is horizontal cross-sectional view of a curved building wall structure constructed in accordance with the present invention.

By way of example, FIG. 5 illustrates a curved building wall structure made in accordance with the present invention. In this embodiment, the interstitial columns 32 comprise annular segments as opposed to the rectangular segments described above in connection with FIGS. 2–4. The design and function of the annularly shaped interstitial columns 32 are nevertheless the same as those described in connection with flat building wall structures. In other words, the curved building wall structure shown in FIG. 5 has the same basic design and structure as that of the flat building wall structure shown in FIGS. 2–4. Accordingly, it should be understood that the words "rectangular columns" and "rectangular blocks", as used herein, include columns and blocks comprising annular segments or having other shapes.

In the preferred embodiments shown, the shape and thickness of interstitial columns 32, the size of rod members 22, 24, the length of composite wall ties 26, the spacing of stud members 20, the size and spacing of transverse rods 48, and the thickness surface coatings 90, 92, 94, 96 (described below) are selected from a design table. The design table of the preferred embodiment provides certain attributes, such as load capacities and allowable heights or spans, for various combinations of these components. Design tables for various building structures, such as wall and roof structures, are not uncommon in the building industry, and provide a simple and quick tool for designing these structures.

Figure 6:
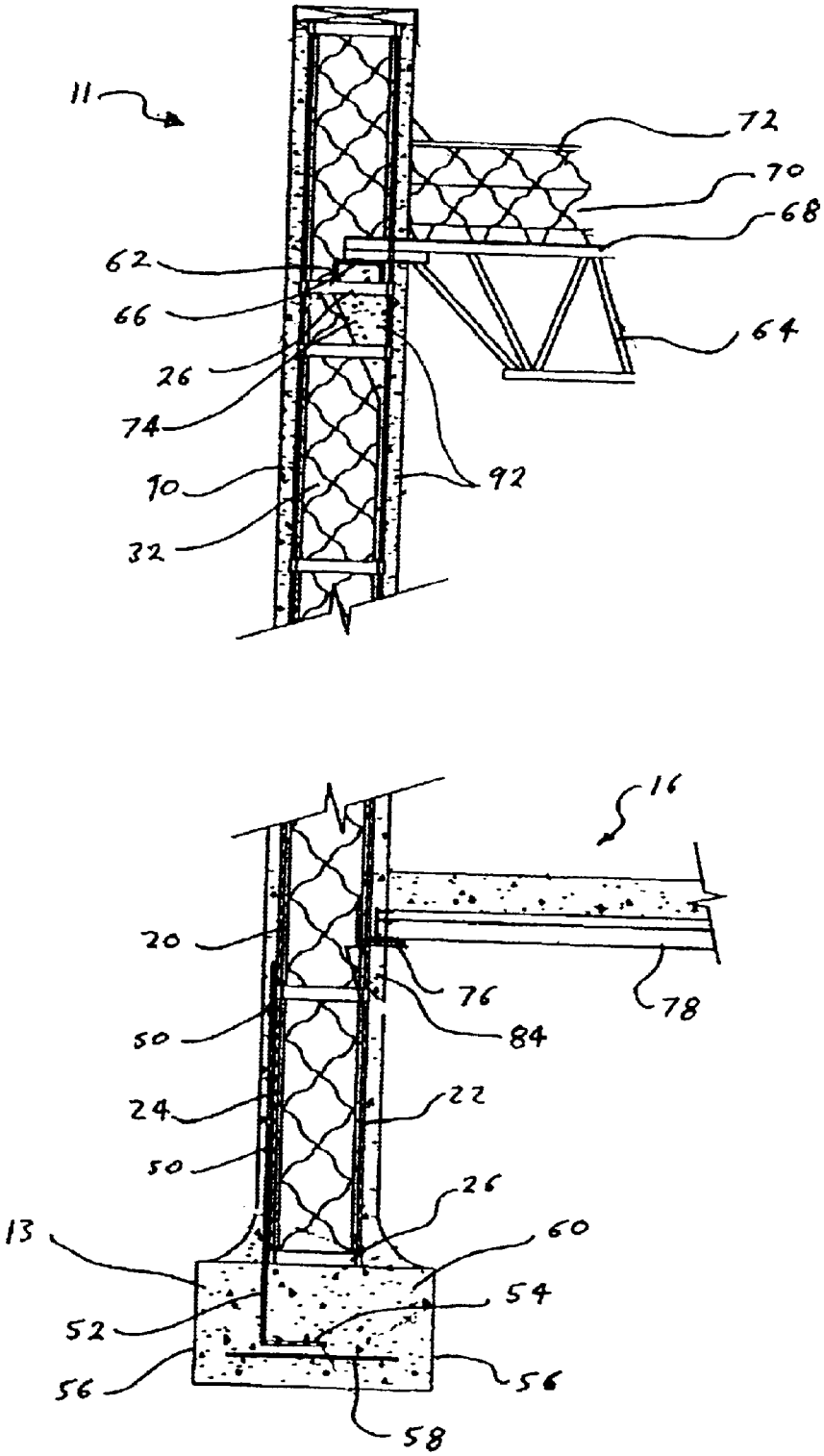
FIG. 6 is cross-sectional view of a building wall structure constructed in accordance with the present invention showing the connection thereof to a concrete footing, a concrete floor structure, and a roof structure.

Referring now to FIGS. 1 and 6, the erection of the wall structures 11, 12 and the connection thereof to the concrete floor and/or footing 13 will now be described. As best seen in FIG. 6, wall structure 11 (or 12) sits upon and is connected to footing 13, which is typically constructed prior to the construction of the wall structure 11. In the specific embodiment shown, stud members 20 are connected to the footing 13 by a series of vertical anchor bars 52 that are partially embedded in the footing 13. The anchor bars 52 are positioned so as to align with the exterior rod members 24 of the wall structure 11. In the preferred embodiment shown, anchor bars 52 are spaced at 2' centers to match the spacing of the stud members 20. In addition, anchor bars 52 preferably comprise standard reinforcing bars. More specifically, and by way of example, anchor bars 52 each comprise #3 dowel bars having a total length of 42", with a 6" bend 54 at one end thereof. As shown in FIG. 6, the bend 54 is embedded in the footing 13 and prevents the anchor bar 52 from being pulled out of the footing 13.

The anchor bars 52 are joined with the rod members 24 by overlapping the ends thereof for a length sufficient to "hold" these components together by frictional forces. In the preferred embodiment shown, anchor bars 52 project 30" above the top of the footing 13, thereby resulting in an overlap of approximately 30" with the rod members 24. Ties 50 are typically used to hold the rod members 24 to the anchor bars 52 until the surface coating 90, 92 has been applied to the wall structure 11.

The anchor bars 52 are typically positioned in the footing 13 at the time the footing 13 is constructed. For example, a typical concrete footing 13 is constructed by placing forms (not shown) directly on the ground on which the footing 13 is to be constructed. These forms define the outside walls 56 of the footing 13. Once the forms are in place, then reinforcement 58 may be positioned within the interior volume of the forms. The reinforcement 58 holds the concrete 60 together and adds strength to the footing 13. The anchor bars 52 are also positioned within the interior volume of the forms at this time. The concrete 60 is then poured into the form and allowed to cure.

Although the embodiment shown only utilizes anchor bars 52 connected to the exterior rod members 24 of each stud member 20, it should be appreciated that anchor bars 52 could also be positioned so as to connect to the interior rod members 22. These additional anchor bars 52 may be necessary depending on the building design and/or building loads.

Other methods of attaching the wall structure 11 to the floor or footing 13 are also contemplated. For example, the anchor bars 52 could be installed into the footing 13 after the footing 13 has been constructed. This could be accomplished by drilling holes (not shown) into the footing and subsequently securing the anchor bars 52 in the holes with an epoxy or some other adhesive.

Although the wall structure 11 is preferably connected to the floor or footing 13 by an anchor device similar to the type described above (i.e., anchor bars 52), anchor devices may be unnecessary for smaller or lightly loaded building structures. In these types of building structures, it may be sufficient to form a channel (not shown) in the top of the footing 13 into which the lower end of the stud members 20 can be positioned. Additional details pertaining to some of these alternative methods of connecting the wall structure 11 to the floor or footing 13 are disclosed in U.S. Pat. No. 4,486,993, issued Dec. 11, 1984, and titled "Building Structure and Method of Construction", the specification of which is hereby incorporated by reference.

As wall structures 11, 12 are being constructed, modifications may be made to the wall structures 11, 12 to accommodate floor and/or roof structures. For example, and as shown in FIG. 6, wall structure 11 has been modified to provide an attachment structure 62 for supporting roof structure 14. As mentioned above, the roof structure 14 is supported by the wall structure 11 (and/or 12) and the oppositely facing wall structure (not shown). In the preferred embodiment shown in FIG. 6, the roof structure comprises a series of steel joist truss members 64 that are designed to span between adjacently facing exterior wall structures 11 and/or 12. The size and design of the truss member 64 is determined by the length of the span, the spacing of the truss members 64, the weight of the roof structure 14, and the live loads that the roof structure is designed to carry. Metal decking 68 is typically attached to, and spans across, the top of the truss members 64. Insulation, such as foam panels 70, is then secured to the top of the metal decking 68. The foam panels 70 are protected by a waterproof and weather resistant layer 72 that is placed over the top thereof.

Each end of the truss member 64 is connected to the wall structure 11 by an attachment structure 62. In the preferred embodiment shown in FIG. 6, the attachment structure 62 comprises a joist bearing channel 66 that is supported on two or more wall ties 26. More specifically, the joist bearing channel 66 is positioned within the wall structure 11 so as to rest on top of the wall ties 26 adjacent to the interior rod member 22 of the stud members 20. An end of the truss member 66 rests on, and is typically welded to, the top of the joist bearing channel 66. The joist bearing channel 66 may be continuous, or may extend only between those stud members 20 on either side of each truss member 66.

In the preferred embodiment shown, the joist bearing channels 66 are also supported by the interior of the wall structure 11. More specifically, and as best seen in FIG. 6, the area 74 beneath the joist bearing channel 66 has been filled with the surface coating material 92. This is done by removing the interstitial column 32 in the area 74, and subsequently permitting this area 74 to be filled with the surface coating material 92 at the time surface coating material 92 is applied to the interior of the wall structure 11. As will be explained in greater detail below, the surface coating material 92, which is typically concrete, is much more durable than the material used for the interstitial columns 32. More importantly, the surface coating material 92 has a much greater compressive strength than the material used for the interstitial columns 32. This permits the weight of the roof structure 14 and any loads thereon to be transferred via the joist bearing channel 66 to the interior surface of the wall structure 11, where it is then distributed across the entire wall structure 11.

It should be appreciated that other types of roof structures 14 could also be utilized in the building structure 10 of the present invention. For example, and as shown in FIG. 1, the roof structure 14 could be constructed in the same manner as the above described wall structures 11. More specifically, the roof structure could comprise a series of stud members 20, with interstitial columns 32 disposed there between, and covered with surface coating materials 94, 96. Utilizing this type of roof structure 14 would eliminate the need for supplemental insulation (i.e., foam panels 70) and waterproof layering materials 72.

Anchoring this type of roof structure 14 to the wall structures 11, 12 would preferably be accomplished in the same manner as anchoring the wall structures 11,12 to the footing 13. For example, and as shown in FIG. 1, "L"-shaped anchor bars 52 could used to structurally connect roof structure 14 with wall structure 11. One leg of an anchor bar 52 would be lapped with either rod member 22 or 24 of the stud member 20 in wall structure 11, and the other leg of the anchor bar 52 would be lapped with either rod member 22 or 24 of the stud member 20 in roof structure 14. The subsequent application of the surface coating material 90, 92, 94, 96 to both the wall structure 11 and the roof structure 14 will result in an integrated structure having a unitary construction.

In addition to above, other types of roof structures 14, and methods of connecting these roof structures 14 to the wall structures 11, 12, are also contemplated. Details pertaining to some of these alternative roof structures 14, and methods of connecting these roof structures 14 to the wall structures 11, 12, are disclosed in U.S. Pat. No. 4,486,993, issued Dec. 11, 1984, and titled "Building Structure and Method of Construction", the specification of which is hereby incorporated by reference.

While the roof structure 14 is shown to form a relatively flat roof, it is well within the scope of those skilled in the art of building construction to utilize wall structures 11 and 12 to support a conventional sloped roof. A conventional sloped roof can be constructed on and supported by wall structures 11 and 12 in any of the above-described methods.

As mentioned above, modifications may be made to the wall structures 11, 12 to accommodate the connection of floor structures 16, 17. As the walls 11 and 12 are being constructed, floor supports 76 are assembled on the studs 20. As shown in FIG. 6, the floor supports 76 preferably comprise angle irons that span across two or more stud members 20. The horizontal flange of each floor support 76 has a plurality of spaced-apart apertures or notches configured to receive rod members 22 of studs 20. The floor supports 76 are preferably positioned so as to rest on top of wall ties 26, with the horizontal leg of the floor support 76 projecting outwardly from the interior face of the wall structure 11.

Similar to the above described manner of supporting the joist bearing channels 66, the floor supports 76 are likewise supported by the interior of the wall structure 11. More specifically, and as best seen in FIG. 6, the area 84 beneath the floor support 76 has been filled with the surface coating material 92. This is done by removing the interstitial column 32 in the area 84, and subsequently permitting this area 84 to be filled with the surface coating material 92 at the time surface coating material 92 is applied to the interior of the wall structure 11. This permits the weight of the floor structure 16, 17, and any loads thereon, to be transferred via the floor support 76 to the interior surface of the wall structure 11, where it is then distributed across the entire wall structure 11.

As shown in FIG. 1, two different floor constructions are illustrated. Floor 16 basically comprises a corrugated steel integral joist or deck 78 extending between the floor supports 76 of wall structure 11 and the floor supports 76 in the opposite wall structures (not shown). Concrete is poured on the steel deck 78 and finished in a conventional manner.

Floor 17 is constructed in a more conventional manner having floor joists 80 extending from the floor support 76 of wall structure 11 to the floor support in the opposite wall (not shown). As shown in the drawing, each of the floor joists 80 extends in a spaced-apart and generally parallel manner. The most remote floor joists 80 are also supported by floor supports 76 in the wall structure 12. Plywood sub-flooring 82 and conventional flooring materials (not shown) are applied over the floor joists as desired.

In addition to above, other types of floor structures 16, 17, and methods of connecting these floor structures 16,17 to the wall structures 11, 12, are also contemplated. Details pertaining to some of these alternative floor structures 16, 17, and methods of connecting these floor structures 16, 17 to the wall structures 11, 12, are disclosed in U.S. Pat. No. 4,486,993, issued Dec. 11, 1984, and titled "Building Structure and Method of Construction", the specification of which is hereby incorporated by reference.

As above described, the building shell 10 is complete except for exterior 90 and interior 92 surface coatings on walls 11, 12, and exterior 94 and interior 96 surface coatings on roof structure 14 (with respect to the embodiment of FIG. 1). As best seen in FIGS. 3 and 4, a surface coating is applied over both surfaces 42 and 44 of the columns 32 of the building structure 18 of the wall structures 11,12 (and roof structure 14 of the embodiment of FIG. 1). This coating material surrounds the rod members 22, 24 of each stud member 20 and most of transverse rods 48. In the specific embodiment shown, this surface coating is a conventional building material such as concrete, plaster or the like. Other materials, such as plastics or epoxies, can also be used.

In the specific embodiment in which concrete is utilized, the concrete is preferably sprayed onto the surfaces 42, 44 of interstitial columns 32 to the desired thickness. As best seen in FIG. 4, control joints 98 can be used to determine when the desired thickness of the surface coating 90, 92, 94, 96 is obtained. In the preferred embodiment shown, the control joints 98 are "M"-shaped metal brackets attached to the outer surface of the transverse bars 48. The control joints 98 have a depth equal to the desired total thickness (as measured from the face of the transverse bars 48) of surface coatings 90, 92, 94, 96. Concrete is then sprayed onto the surfaces 42, 44 of interstitial columns 32 in thin layers until the control joints 98 have been covered.

It should be appreciated that the control joints 98 can comprise any number of shapes depending on the required depth and location within the wall structure 11, 12.

Although the above-described procedure involves spraying the concrete onto the surfaces 42, 44 of interstitial columns 32 to form surface coatings 90, 92, 94, 96, it should be appreciated that the concrete can alternatively be poured into forms. For example, concrete forms would be spaced away from the surfaces 42, 44 of interstitial columns 32 and positioned so as to define the outer surface of the surface coatings 90, 92, 94, 96. Concrete is then poured into the gap between the forms and the interstitial columns 32 and allowed to cure. Once the concrete has cured, the forms can be removed. This method of concrete forming is particularly common for constructing the foundation walls of smaller buildings and houses.

Embedding the rod members 22, 24 and most of the transverse bars 48 in concrete (or a similarly durable material) results in the construction of a wall structure 11, 12 (or the roof structure 14 of the embodiment of FIG. 1) capable of bearing considerable loads. As shown in FIG. 6, the surface coating 90, 92 can also be used to cap the top of wall structures 11, 12. Conventional paint, wall board, paneling or the like (not shown) can then be applied to the interior surface coating 92 and 96 of the wall structures 11, 12 and roof structure 14, respectively. Similarly, paint and/or other weather protective coatings such as tar (not shown) can be applied to the exterior coating 90 and 94 of the wall structures 11, 12 and roof structure 14, respectively.

Figure 7A:
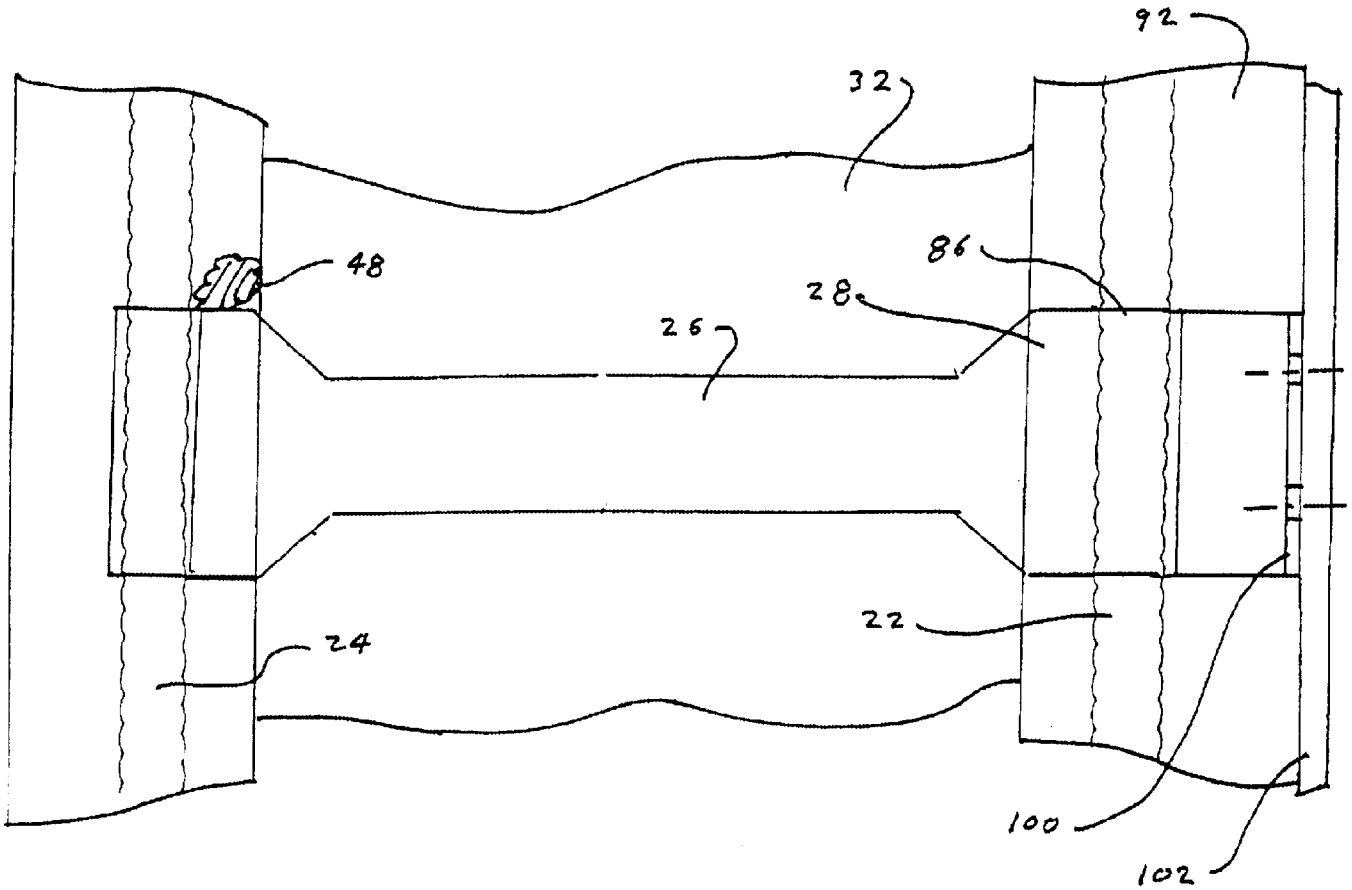
FIG. 7A is an enlarged view of an alternative wall tie.
Figure 7B:
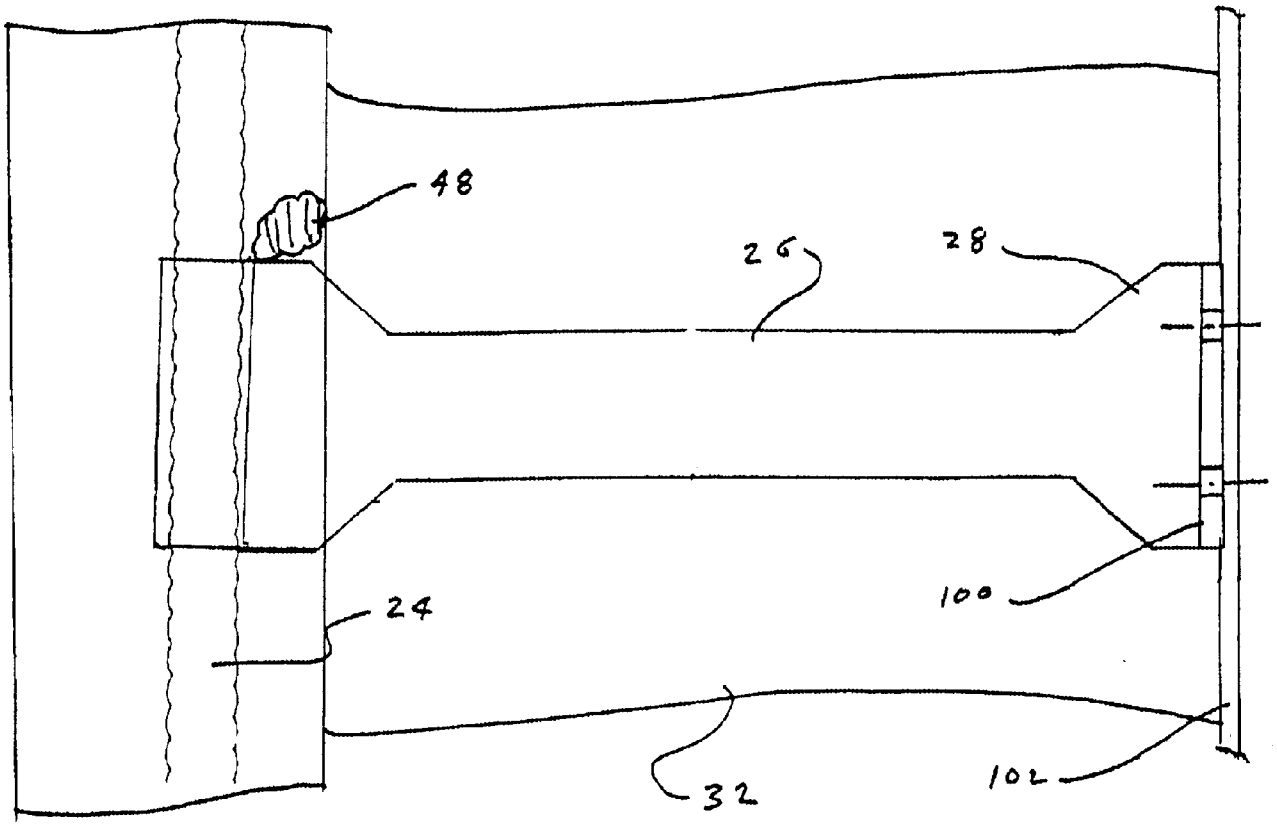
FIG. 7B is an enlarged view of another alternative wall tie.

To facilitate the attachment of surface materials to the wall structure 11, 12 (or the roof structure 14 of the embodiment of FIG. 1), wall ties 26 can be modified as shown in FIGS. 7A and 7B. In the specific embodiment shown in FIG. 7A, the interior end 28 of wall tie 26 further comprises a flange 100 adapted for attachment to sheet materials 102 such as plywood or sheetrock, thereby eliminating the need to anchor these sheet materials 102 to the interior surface coating 92, 96.

The wall tie 26 shown in FIG. 7B is similar to the wall tie 26 shown in FIG. 7A, but does not include an opening 86 at the interior end 28. This type of wall tie 26 would be utilized for wall structures 11, 12 not requiring any interior reinforcing (i.e., interior rod members 24 and interior transverse rods 48) or interior surface coatings 92. In other words, the interior sheet materials 102 would be applied directly against the interior surface 42 of interstitial columns 32. Like the embodiment described in connection with FIG. 7A, the flange 100 of the wall tie 26 provides an anchor point for the sheet materials 102.

It should be appreciated that wall ties 26 having other types and shapes of attachment structures can also be utilized depending on the nature of the material to be attached thereto.

It should also be appreciated that the present invention contemplates other types of surface materials in addition to those described above. While conventional building materials are preferable inasmuch as their characteristics are well known and they are readily available at low cost, other more exotic surface materials such as plastic, epoxies or the like can also be utilized.

Figure 8:
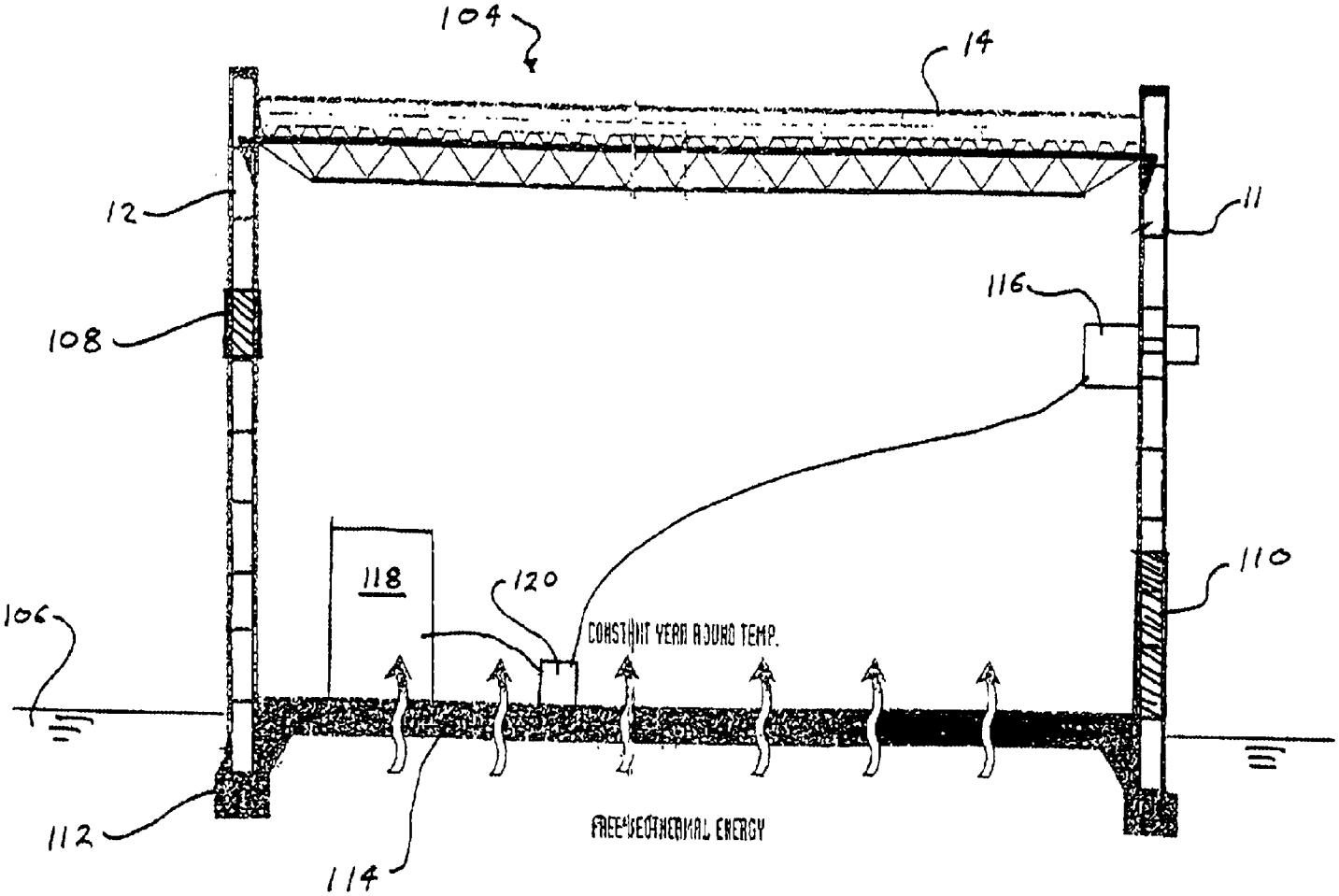
FIG. 8 is a representational view of an energy-free building structure according to the present invention.

As shown representatively in FIG. 8, the above-described composite building wall 11, 12 and roof 14 structures are incorporated into an earth coupled geo-thermal energy free building 104. In particular, the earth coupled geothermal energy free building 104 utilizes wall 11, 12 and roof 14 structures constructed in accordance with the present invention. In the preferred embodiment shown, the wall 11, 12 and roof 14 structures each have an insulating rating of at least R-35. Moreover, all interior structural elements, such as bar joists and columns, are isolated from exterior wall and roof components to eliminate, or at least minimize, the transfer of heat between the interior of the building 104 and the ambient surroundings. In particular, all structural or other elements connected between the interior and exterior surfaces of the building 104 should comprise a thermal break, so long as the structural integrity of the building 104 is not compromised.

A lower portion of the earth coupled geo-thermal energy free building 104 extends into the ground 106 so as to utilize the geo-thermal energy of the ground 106. In particular, the foundation 112 and/or floor 114 of the building 104 generally extends beneath the frost line of the ground 106, and similarly has an insulating rating of at least R-35. Moreover, and as will be explained below, the area of the foundation 112 and/or floor 114 of the building 104 which extends below the frost line of the ground 106 should be maximized to increase the geothermal coupling of the building 104 with the ground 106. In addition, that portion of the foundation 112 and/or floor 114 that extends below the frost line of the ground 106 should not be insulated from the ground 106.

Windows 108, doors 110, and other building components that typically have lower insulating capacities are kept to a minimum. To the extent that windows 108 and doors 11 must be incorporated into the wall 11, 12 and roof 14 structures of the building 104, these elements should be energy efficient and have proper weather stripping. In the preferred embodiment shown, the doors 110 comprise air-lock entries to minimize the exchange of heat between the interior of the building 104 and the ambient surroundings that is ordinarily created by the opening of the doors 110.

As explained above, the earth coupled geo-thermal energy free building 104 of the present invention utilizes the geo-thermal energy of the ground 106, which tends to remain at a constant temperature. For example, the ground 106 in most areas of the continental United States has a relatively constant temperature below the frost line that measures in the range of 50° F. to 70° F., depending on the geographic location. Thus, the thermal mass of the building 104, as well as the interior thereof, will similarly tend to maintain a constant temperature equal to that of the ground 106 below the frost line (i.e., in the range of 50° F. to 70° F., depending on the geographic location of the building 104).

In addition, because of the superior insulating capacity of the building 104, the interior of the building 104 will tend to maintain a constant temperature irrespective of any fluctuations in the air temperature of the ambient surroundings. This is because the thermal mass of the building 104 has been isolated from the outside environment. The thermal mass of the building 104 generally includes all of the internal structural elements or components of the building 104 such as interior walls, furniture, machinery, etc. Because these elements have a mass, they tend to maintain a constant temperature absent exposure to hotter or colder temperatures. Moreover, because these elements are isolated from the outside, they should maintain a constant temperature irrespective of the outside air temperature.

Of course, and depending on the type of working conditions desired for the interior of the building 104, it is usually desirable to maintain an interior temperature of approximately 70° F., or at least in the range of 65° F. to 75° F. Accordingly, additional energy (BTU's) must be added to increase the interior temperature of the building 104 to the desired temperature (e.g., 70° F.). This additional energy is ordinarily supplied by people, lighting, machinery, and any other heat producing equipment operating within the building 104.

Although the interior of the building 104 will tend to maintain a constant temperature irrespective of any fluctuations in the air temperature of the ambient surroundings, it should be appreciated that the interior temperature of the building 104 may vary as a result the internal use of the building 104. For example, the interior temperature of the building 104 may be increased as a result of heat supplied by people, lighting, machinery, and any other heat producing equipment operating within the building 104. To the extent that such uses result in excess heat (BTU's), then such heat is preferably dissipated or vented from the building 104 by air exchangers 116.

To the extent that additional energy (BTU's) is still required to maintain the desired interior temperature of the building 104, then an HVAC system 118 may be provided to either raise or lower the temperature thereof. However, it should be appreciated that the size of, or requirements for, an HVAC system 118 would be minimal in view of the design and function of the earth coupled geothermal coupling building 104 of the present invention, and would instead be more dependent on the nature of the usage of the building.

The earth coupled geo-thermal energy free building 104 of the preferred embodiment further comprises air exchangers 116 to provide proper ventilation and ensure that the air inside the building 104 remains clean. In particular, air exchangers 116 are used to change the interior air from stale to fresh. Air exchangers 116 are also used to move energy (BTU's) between different areas of the building 104 so as to equalize the temperatures throughout. For example, heat exchangers 116 could be used to move warm air from near the roof structure 14 of the building 104 downwardly so as to increase the temperature (i.e., warm) near the floor 114 of the building 104. Although some of these functions could be accomplished by manually opening windows 108 or doors 110, windows 108 and doors 110 typically lack the controls or monitors necessary for effective energy management. Accordingly, air exchangers 116 are preferably controlled by a computerized environmental control system 120. The computerized environmental control system 120 would also operate the HVAC system 118.

The improved building structure of the invention provides a building structure having many of the properties of modular building panels, yet retaining many of the advantages of conventional on-site construction. The improved building structure of the invention can be used for both exterior and interior walls and roof structures. In addition, the improved building structure of the invention can be used as a load bearing wall structure.

While there have been described above the principles of this invention in connection with specific apparatus, it is to be clearly understood that this description is made only by way of example and not as a limitation to the scope of the invention.

What is claimed is:

1. A load bearing composite building wall structure comprising:

a plurality of spaced-apart stud members, each of said stud members comprising an exterior bar member that is disposed along an exterior face of said wall structure, an interior bar member that is disposed along an interior face of said wall structure, and a plurality of wall ties connected between said exterior bar member and said interior bar member;

interstitial blocks disposed between adjacent pairs of stud members and spaced inwardly of the exterior and interior faces of said wall structure, said interstitial blocks each being comprised of a generally self-supporting material;

a plurality of transverse rod members extending between adjacent pairs of stud members, said transverse rod members generally being disposed between the exterior and interior faces of said wall structure and outwardly of said interstitial blocks; and a surface coating material disposed along the exterior and interior faces of said wall structure and in contact with the interstitial blocks, said interior bar members, said exterior bar members, and said transverse rod members generally being embedded in said surface coating material, wherein a portion of the surface coating material has an increased thickness in an area adjacent to one or more stud members, said increased thickness providing an increased load bearing capacity to the wall structure.

2. The load bearing composite building wall structure according to claim 1 wherein the increased thickness of the surface coating material is formed by removing a portion of the interstitial blocks.

3. The load bearing composite building wall structure according to claim 1 wherein the interstitial blocks each comprise a center portion bounded by two edge portions, said edge portions being disposed adjacent to said stud members, further wherein the interstitial blocks each have a thickness that is greater in the center portion than at the edge portions.

4. The load bearing composite building wall structure according to claim 3 wherein the edge portions each have a tapered shape.

5. The load bearing composite building wall structure according to claim 3 wherein the edge portions each have a notched shape.

6. The load bearing composite building wall structure according to claim 1 wherein the exterior bar member of each of said stud members comprises a standard reinforcing bar.

7. The load bearing composite building wall structure according to claim 1 wherein the exterior bar member and the interior bar member of said stud members each comprise standard reinforcing bars, and further wherein said wall ties each comprise an exterior end and an interior end, said exterior end being configured so as to permit the exterior bar member to pass through an opening in said exterior end, and said interior end being configured so as to permit the interior bar member to pass through an opening in said interior end.

8. The load bearing composite building wall structure according to claim 1 wherein said plurality of wall ties each comprise an exterior end and an interior end, said exterior end being adapted to connect to the exterior bar member, and said interior end being adapted to connect to the interior bar member.

9. The load bearing composite building wall structure according to claim 1 wherein said plurality of wall ties each comprise an attachment structure for connecting to sheet materials, said sheet materials being disposed against the interior face of said wall structure.

10. The load bearing composite building wall structure according to claim 9 wherein said sheet materials comprise plywood.

11. The load bearing composite building wall structure according to claim 9 wherein said sheet materials comprise sheetrock.

12. The load bearing composite building wall structure according to claim 9 wherein said sheet materials comprise foam insulation panels.

13. The load bearing composite building wall structure according to claim 1 wherein the transverse rod members each comprise standard reinforcing bars.

14. The load bearing composite building wall structure according to claim 1 wherein said wall structure functions as a building roof structure.

15. The load bearing composite building wall structure according to claim 1 wherein said wall structure is substantially straight, and wherein said interstitial blocks each comprise a center portion bounded by two edge portions, said edge portions being disposed adjacent to said stud members, and said center portion having a generally planar surface.

16. The load bearing composite building wall structure according to claim 1 wherein said wall structure is curved, and wherein said interstitial blocks each comprise a center portion bounded by two edge portions, said edge portions being disposed adjacent to said stud members, and said center portion having a generally curved surface.

17. The load bearing composite building wall structure according to claim 1 wherein control joints are utilized to determine the thickness of the surface coating material.

18. The load bearing composite building wall structure according to claim 17 wherein the control joints are connected to transverse rod members, said control joints having a depth that is equivalent to a thickness of the surface coating material that is to be applied outwardly from the transverse rod members.

19. The load bearing composite building wall structure according to claim 17 wherein the control joints each comprise "M"-shaped members.

20. The load bearing composite building wall structure according to claim 1 wherein the surface coating material comprises concrete.

21. The load bearing composite building wall structure according to claim 20 wherein the concrete has been deposited onto the surface of the wall structure by a spraying operation.

22. The load bearing composite building wall structure according to claim 1 wherein the interstitial blocks are comprised of an insulating material.

23. The load bearing composite building wall structure according to claim 1 wherein the plurality of wall ties each comprise a composite material having a low rate of heat transfer.

24. A load bearing composite building wall structure comprising:

a plurality of spaced-apart stud members, each of said stud members comprising an exterior bar member that is disposed along an exterior face of said wall structure, an interior bar member that is disposed along an interior face of said wall structure, and a plurality of wall ties connected between said exterior bar member and said interior bar member;

interstitial blocks disposed between adjacent pairs of stud members and spaced inwardly of the exterior and interior faces of said wall structure, said interstitial blocks each being comprised of a generally self-supporting material;

a plurality of transverse rod members extending between adjacent pairs of stud members, said transverse rod members generally being disposed between the exterior and interior faces of said wall structure and outwardly of said interstitial blocks; and a surface coating material disposed along the exterior and interior faces of said wall structure and in contact with the interstitial blocks, said interior bar members, said exterior bar members, and said transverse rod members generally being embedded in said surface coating material, wherein the surface coating material has a first thickness in a first area adjacent to each of said stud members, and a second thickness in a second area that is between each pair of adjacent stud members, said first thickness being greater than said second thickness.

25. The load bearing composite building wall structure according to claim 24 wherein the interstitial blocks each comprise a center portion bounded by two edge portions, said center portion being disposed adjacent to said first area, and said edge portions being disposed adjacent to said second areas, further wherein the interstitial blocks each have a thickness that is greater in the center portion than at the edge portions.

26. The load bearing composite building wall structure according to claim 25 wherein the edge portions each have a tapered shape.

27. The load bearing composite building wall structure according to claim 25 wherein the edge portions each have a notched shape.

28. The load bearing composite building wall structure according to claim 24 wherein the exterior bar member of each of said stud members comprises a standard reinforcing bar.

29. The load bearing composite building wall structure according to claim 24 wherein said plurality of wall ties each comprise an exterior end and an interior end, said exterior end being adapted to connect to the exterior bar member, and said interior end being adapted to connect to the interior bar member.

30. The load bearing composite building wall structure according to claim 24 wherein said plurality of wall ties each comprise an attachment structure for connecting to sheet materials, said sheet materials being disposed against the interior face of said wall structure.

31. The load bearing composite building wall structure according to claim 30 wherein said sheet materials comprise plywood.

32. The load bearing composite building wall structure according to claim 30 wherein said sheet materials comprise sheetrock.

33. The load bearing composite building wall structure according to claim 30 wherein said sheet materials comprise foam insulation panels.

34. The load bearing composite building wall structure according to claim 24 wherein the transverse rod members each comprise standard reinforcing bars.

35. The load bearing composite building wall structure according to claim 24 wherein said wall structure functions as a building roof structure.

36. The load bearing composite building wall structure according to claim 24 wherein said wall structure is substantially straight, and wherein said interstitial blocks each comprise a center portion bounded by two edge portions, said edge portions being disposed adjacent to said stud members, and said center portion having a generally planar surface.

37. The load bearing composite building wall structure according to claim 24 wherein said wall structure is curved, and wherein said interstitial blocks each comprise a center portion bounded by two edge portions, said edge portions being disposed adjacent to said stud members, and said center portion having a generally curved surface.

38. The load bearing composite building wall structure according to claim 24 wherein control joints are utilized to determine the thickness of the surface coating material.

39. The load bearing composite building wall structure according to claim 38 wherein the control joints are connected to transverse rod members, said control joints having a depth that is equivalent to a thickness of the surface coating material that is to be applied outwardly from the transverse rod members.

40. The load bearing composite building wall structure according to claim 38 wherein the control joints each comprise "M"-shaped members.

41. The load bearing composite building wall structure according to claim 24 wherein the surface coating material comprises concrete.

42. The load bearing composite building wall structure according to claim 41 wherein the concrete has been deposited onto the surface of the wall structure by a spraying operation.

43. The load bearing composite building wall structure according to claim 24 wherein the interstitial blocks are comprised of an insulating material.

44. The load bearing composite building wall structure according to claim 24 wherein the plurality of wall ties each comprise a composite material having a low rate of heat transfer.

45. A load bearing composite building wall structure comprising:

a plurality of spaced-apart stud members, each of said stud members comprising an exterior bar member that is disposed along an exterior face of said wall structure, an interior bar member that is disposed along an interior face of said wall structure, and a plurality of wall ties connected between said exterior bar member and said interior bar member;

interstitial blocks disposed between adjacent pairs of stud members and spaced inwardly of the exterior and interior faces of said wall structure, said interstitial blocks each being comprised of a generally self-supporting material;

a plurality of transverse rod members extending between adjacent pairs of stud members, said transverse rod members generally being disposed between the exterior and interior faces of said wall structure and outwardly of said interstitial blocks; and a surface coating material disposed along the exterior and interior faces of said wall structure and in contact with the interstitial blocks, said interior bar members, said exterior bar members, and said transverse rod members generally being embedded in said surface coating material, wherein a portion of the surface coating material has an increased thickness in an area adjacent to one or more stud members, said increased thickness providing an increased load bearing capacity to the wall structure, and wherein said plurality of wall ties each comprise an attachment structure for connecting to a sheet material, said sheet material being disposed against the interior face of said wall structure.

46. The load bearing composite building wall structure according to claim 45 wherein said sheet material comprises plywood.

47. The load bearing composite building wall structure according to claim 45 wherein said sheet material comprises sheetrock.

48. The load bearing composite building wall structure according to claim 45 wherein said sheet material comprises a foam insulation panel.

49. A load bearing composite building wall structure comprising:

a plurality of spaced-apart stud members, each of said stud members comprising an exterior bar member that is disposed along an exterior face of said wall structure, an interior bar member that is disposed along an interior face of said wall structure, and a plurality of wall ties connected between said exterior bar member and said interior bar member;

interstitial blocks disposed between adjacent pairs of stud members and spaced inwardly of the exterior and interior faces of said wall structure, said interstitial blocks each being comprised of a generally self-supporting material;

a plurality of transverse rod members extending between adjacent pairs of stud members, said transverse rod members generally being disposed between the exterior and interior faces of said wall structure and outwardly of said interstitial blocks; and a surface coating material disposed along the exterior and interior faces of said wall structure and in contact with the interstitial blocks, said interior bar members, said exterior bar members, and said transverse rod members generally being embedded in said surface coating material, wherein a portion of the surface coating material has an increased thickness in an area adjacent to one or more stud members, said increased thickness providing an increased load bearing capacity to the wall structure, and wherein control joints are utilized to determine the thickness of the surface coating material.

50. The load bearing composite building wall structure according to claim 49 wherein the control joints are connected to transverse rod members, said control joints having a depth that is equivalent to a thickness of the surface coating material that is to be applied outwardly from the transverse rod members.

51. The load bearing composite building wall structure according to claim 49 wherein the control joints each comprise "M"-shaped members.

52. A load bearing composite building wall structure comprising:

a plurality of spaced-apart stud members, each of said stud members comprising an exterior bar member that is disposed along an exterior face of said wall structure, an interior bar member that is disposed along an interior face of said wall structure, and a plurality of wall ties connected between said exterior bar member and said interior bar member;

interstitial blocks disposed between adjacent pairs of stud members and spaced inwardly of the exterior and interior faces of said wall structure, said interstitial blocks each being comprised of a generally self-supporting material;

a plurality of transverse rod members extending between adjacent pairs of stud members, said transverse rod members generally being disposed between the exterior and interior faces of said wall structure and outwardly of said interstitial blocks; and a surface coating material disposed along the exterior and interior faces of said wall structure and in contact with the interstitial blocks, said interior bar members, said exterior bar members, and said transverse rod members generally being embedded in said surface coating material, wherein the surface coating material has a first thickness in a first area adjacent to each of said stud members, and a second thickness in a second area that is between each pair of adjacent stud members, said first thickness being greater than said second thickness, and wherein said plurality of wall ties each comprise an attachment structure for connecting to sheet materials, said sheet materials being disposed against the interior face of said wall structure.

53. The load bearing composite building wall structure according to claim 52 wherein said sheet materials comprise plywood.

54. The load bearing composite building wall structure according to claim 52 wherein said sheet materials comprise sheetrock.

55. The load bearing composite building wall structure according to claim 52 wherein said sheet materials comprise foam insulation panels.

56. A load bearing composite building wall structure comprising:

a plurality of spaced-apart stud members, each of said stud members comprising an exterior bar member that is disposed along an exterior face of said wall structure, an interior bar member that is disposed along an interior face of said wall structure, and a plurality of wall ties connected between said exterior bar member and said interior bar member;

interstitial blocks disposed between adjacent pairs of stud members and spaced inwardly of the exterior and interior faces of said wall structure, said interstitial blocks each being comprised of a generally self-supporting material;

a plurality of transverse rod members extending between adjacent pairs of stud members, said transverse rod members generally being disposed between the exterior and interior faces of said wall structure and outwardly of said interstitial blocks; and a surface coating material disposed along the exterior and interior faces of said wall structure and in contact with the interstitial blocks, said interior bar members, said exterior bar members, and said transverse rod members generally being embedded in said surface coating material, wherein the surface coating material has a first thickness in a first area adjacent to each of said stud members, and a second thickness in a second area that is between each pair of adjacent stud members, said first thickness being greater than said second thickness, and wherein control joints are utilized to determine the thickness of the surface coating material.

57. The load bearing composite building wall structure according to claim 56 wherein the control joints are connected to transverse rod members, said control joints having a depth that is equivalent to a thickness of the surface coating material that is to be applied outwardly from the transverse rod members.

58. The load bearing composite building wall structure according to claim 56 wherein the control joints each comprise "M"-shaped members.

* * * * *